US006718153B2

(12) United States Patent
Nishimura et al.

(10) Patent No.: US 6,718,153 B2
(45) Date of Patent: Apr. 6, 2004

(54) DEVELOPING DEVICE FOR PREVENTING THICKENING OF THE DEVELOPER AT BOTH ENDS OF A SLEEVE

(75) Inventors: Ryoji Nishimura, Osaka (JP); Yasuyuki Hirai, Osaka (JP); Kotaro Kawasaki, Osaka (JP); Satoru Yonemoto, Osaka (JP); Naoyuki Ishida, Osaka (JP); Yukihiro Ito, Osaka (JP); Hideki Kitagawa, Osaka (JP); Hideki Takeda, Osaka (JP); Shinsuke Kawashima, Osaka (JP)

(73) Assignee: Kyocera Mita Corporation, Osaka (JP)

( * ) Notice: Subject to any disclaimer, the term of this patent is extended or adjusted under 35 U.S.C. 154(b) by 0 days.

(21) Appl. No.: 10/283,064

(22) Filed: Oct. 30, 2002

(65) Prior Publication Data

US 2003/0103783 A1 Jun. 5, 2003

(30) Foreign Application Priority Data

Nov. 30, 2001 (JP) ..... 2001-365838

(51) Int. Cl.[7] ..... G03G 15/09
(52) U.S. Cl. ..... 399/274; 399/277
(58) Field of Search ..... 399/277, 276, 399/264, 411, 267, 268, 272, 274, 275

(56) References Cited

U.S. PATENT DOCUMENTS 6,070,037 A * 5/2000 Sugihara et al. ..... 399/274
6,078,768 A * 6/2000 Suzuki ..... 399/267
6,473,586 B2 * 10/2002 Noda et al. ..... 399/277

FOREIGN PATENT DOCUMENTS

| | | | | |
|---|---|---|---|---|
| JP | 57070574 A | * | 5/1982 | ..... G03G/15/09 |
| JP | 3-71366 | | 7/1991 | |
| JP | 08137244 A | * | 5/1996 | ..... G03G/15/09 |
| JP | 9-26702 | | 1/1997 | |
| JP | 10254245 A | * | 9/1998 | ..... G03G/15/09 |
| JP | 2000-98738 | | 4/2000 | |

OTHER PUBLICATIONS

JPO Office Action of Dec. 16, 2003.

Translation of Dec. 16, 2003 JPO Action.

* cited by examiner

*Primary Examiner*—William J. Royer
(74) *Attorney, Agent, or Firm*—Smith, Gambrell & Russell, LLP

(57) ABSTRACT

In a developing device according to the present invention, a developing roller 8 has a fixed shaft 12 and a sleeve 13. The length of a draw-up magnetic pole N3 provided in the fixed shaft 12 is made shorter than the length of a main magnetic pole N1. Accordingly, the amount of a developer adhering to both ends of an outer peripheral surface of the sleeve 13 is reduced, so that the density of the developer at both the ends of the sleeve 13 is maintained in suitable conditions in a state where the developer is over the main magnetic pole N1.

4 Claims, 2 Drawing Sheets

DEVELOPING DEVICE FOR PREVENTING THICKENING OF THE DEVELOPER AT BOTH ENDS OF A SLEEVE

BACKGROUND OF THE INVENTION

1. Field of the Invention

The present invention relates to a developing device utilized for an electrophotographic copying machine, a facsimile, a printer, or the like, and more particularly, to a developing device using a two-component developer having toner particles and carrier particles.

2. Description of Related Arts

In the field of image forming apparatuses that form images by electrophotographic systems, developing devices using a two-component developer having toner particles and carrier particles have been known. Such a developing device is arranged in close proximity to a photosensitive drum or the like in order to develop an electrostatic latent image formed on a surface of the photosensitive drum into a toner image. The developer in a suitable amount is supplied to the surface of the photosensitive drum by a developing roller provided in the developing device, and the toner in the developer is selectively electrostatically attracted by the electrostatic latent image formed on the surface of the photosensitive drum when the developer is rubbed onto the surface of the photosensitive drum. Accordingly, the electrostatic latent image on the photosensitive drum is developed into the toner image.

Meanwhile, in the conventional developing device, the density of the developer supplied to the photosensitive drum is not uniformly distributed, as viewed in the axial direction of the developing roller. Accordingly, the density of the developer at both ends in the axial direction of the developing roller is liable to be in a higher concentration than that at the center thereof. Specifically, the thickness of the developer magnetically adsorbed on an outer peripheral surface of the developing roller is larger at both the ends in the axial direction of the developing roller than that at the center thereof (the height of the developer from an outer surface of the developing roller is large).

Therefore, the surface at both ends in the axial direction of the photosensitive drum is more strongly rubbed by the developer, as compared with the other portion, whereby the photosensitive layer at both the ends of the photosensitive drum is roughened. When a photosensitive layer is roughened, the concentration at both ends of an image to be formed is reduced, or a background of the image is fogged, for example.

SUMMARY OF THE INVENTION

An object of the present invention is to solve such a problem and to provide a developing device that prevents a photosensitive layer from being easily roughened in a part of its surface, particularly at both its ends.

Another object of the present invention is to provide a developing device improved such that the thickness of a developer is not larger at both ends in the axial direction of a developing roller than that at the center thereof.

The present invention is directed to a developing device for developing an electrostatic latent image into a toner image using a two-component developer having toner particles and carrier particles, characterized in that the length of a draw-up magnetic pole is made shorter than the length of a main magnetic pole such that both ends in the axial direction of the draw-up magnetic pole are respectively inward in the axial direction by a predetermined length from both ends in the axial direction of the main magnetic pole.

The present invention is directed to a developing device for developing an electrostatic latent image into a toner image using a two-component developer having toner particles and carrier particles, characterized in that the space between a control plate for restricting the thickness of the developer to a predetermined thickness and an outer peripheral surface of a sleeve is made narrower in regions at both ends in the axial direction of the control plate than that in the other region.

Generally, the developer magnetically adsorbed onto the outer peripheral surface of the sleeve by the draw-up magnetic pole extends toward both ends of the sleeve beyond the length of the draw-up magnetic pole when it passes through the control plate. When the sleeve is rotated to a position over the main magnetic pole in the state, a magnetic force at both ends of the main magnetic pole attracts the developer extending toward both the ends of the sleeve. Therefore, the density of the developer over at both the ends of the main magnetic pole, that is, the thickness of the developer adsorbed on both ends of the outer peripheral surface of the sleeve is increased.

In order to solve such a problem, in the present invention, the length of the draw-up magnetic pole is made shorter than the length of the main magnetic pole. Therefore, the amount of the developer adhering to both ends of the outer peripheral surface of the sleeve is reduced, so that the density of the developer at both the ends of the sleeve is maintained in suitable conditions in a state where the developer is opposite to the main magnetic pole.

The length of the draw-up magnetic pole is thus made shorter than that of the main magnetic pole, thereby narrowing a range in which the developer is put, as viewed in the axial direction, on the outer peripheral surface of the sleeve before passing through the control plate, to prevent the developer from excessively extending toward both ends in the axial direction of the sleeve when the developer passes through the control plate. Consequently, both ends of a photosensitive layer are prevented from being excessively rubbed, thereby making it possible to prevent both ends of the photosensitive layer from being roughened or worn. Accordingly, the image quality at both ends of a formed image is not degraded. As a result, the life of a photosensitive drum can be improved.

In the present invention, out of the developers magnetically adsorbed on the outer peripheral surface of the sleeve by the draw-up magnetic pole, the thickness of the developer adhering to both the ends in the axial direction of the sleeve is restricted to decrease. That is, the thickness of the developer in a portion other than both the ends in the axial direction of the sleeve is restricted to a predetermined thickness, and the thickness of the developer at both the ends of the sleeve is restricted to a thickness smaller than the predetermined thickness. Therefore, the developer which has extended toward both the ends of the sleeve is attracted by both the ends of the main magnetic pole when it is over the main magnetic pole. However, the thickness of the developer at both the ends of the main magnetic pole is restricted to a small thickness. Accordingly, the developer is attracted by the main magnetic pole, so that the thickness of the developer is approximately equal to the thickness at the center of the main magnetic pole.

Accordingly, only the thickness of the developer at both the ends of the sleeve can be prevented from being increased.

The foregoing and other objects, features, aspects and advantages of the present invention will become more apparent from the following detailed description of the present invention when taken in conjunction with the accompanying drawings.

DESCRIPTION OF THE PREFERRED EMBODIEMNTS

Figure 1:
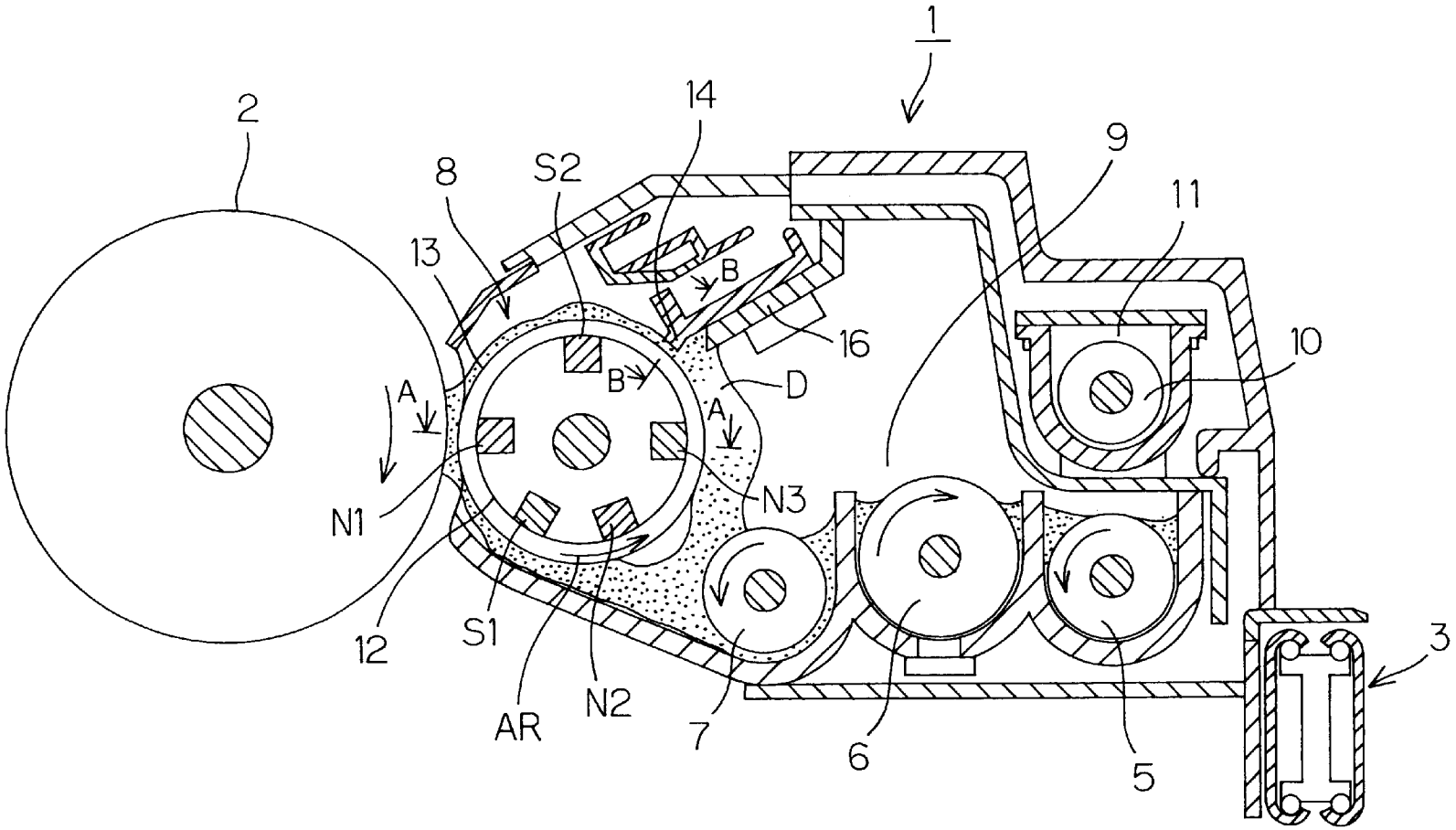
FIG. 1 is a cross-sectional view of a developing device according to an embodiment of the present invention, which together illustrates a photosensitive drum.

FIG. 1 is a cross-sectional view of a developing device 1 according to an embodiment of the present invention, which together illustrates a photosensitive drum 2 in an image forming apparatus on which the developing device 1 is mounted.

A slide rail mechanism 3 is attached to the developing device 1. The developing device 1 is supported on the slide rail mechanism 3, and can be pulled out forward in a direction perpendicular to the paper.

The developing device 1 contains a two-component developer D having a toner and a carrier, and comprises three agitating rollers 5, 6, and 7 for agitating the developer D and a developing roller 8 for conveying the developer D to a surface of the photosensitive drum 2. Further, there are provided a toner supply roller 10 for supplying the toner when the density of the toner included in the developer D within a containing chamber 9 decreases, and a sub toner hopper 11 accommodating the toner supply roller 10. They are arranged adjacent to each other outside the containing chamber 9.

The developing roller 8 has a columnar fixed shaft 12 and a cylindrical sleeve 13 externally fitted to the fixed shaft 12 and rotating in a direction indicated by an arrow AR (in a counterclockwise direction in the drawing). The fixed shaft 12 and the sleeve 13 respectively extend in a direction perpendicular to the paper. In the fixed shaft 12, five magnets, for example, extending in the axial direction are spaced a predetermined distance apart from one another along a peripheral surface of the fixed shaft 12. The five magnets include a main magnetic pole N1 provided at a position opposite to the photosensitive drum 2, a draw-up magnetic pole N3 provided at a position spaced approximately 180° apart from the main magnetic pole N1, an auxiliary magnetic pole S2 provided at an approximately intermediate portion directed toward the main magnetic pole N1 from the draw-up magnetic pole N3, as viewed in the direction of rotation of the sleeve 13, and two auxiliary magnetic poles S1 and N2 arranged in this order at positions directed from the main magnetic pole N1 to the draw-up magnetic pole N3.

The developer D is magnetically adsorbed on an outer peripheral surface of the sleeve 13 by a magnetic force (a magnetic field) produced by the five magnets provided on the fixed shaft 12. The reason for this is that the developer D is a mixture of a carrier and a toner each made of magnetic particles, the carrier and the toner are attracted to each other by static electricity generated due to friction by agitation, and the carrier is magnetically attracted to the outer peripheral surface of the sleeve 13 by a magnetic force.

In this case, the developer D is attracted to the outer peripheral surface of the sleeve 13 by the draw-up magnetic pole N3. When the sleeve 13 is rotated at a predetermined speed in a counterclockwise direction, the developer D absorbed on the outer peripheral surface of the sleeve 13 reaches a control plate 14. The control plate 14 restricts the amount of the developer D magnetically adsorbed on the outer peripheral surface of the sleeve 13, that is, the thickness of the developer D on the outer peripheral surface of the sleeve 13 so that the developer D in a suitable amount is conveyed to the photosensitive drum 2. The control plate 14 is supported by a supporting member 16. The developer D whose thickness is restricted by the control plate 14 is attracted by a magnetic force of the auxiliary magnetic pole S2, and is further fed to a position opposite to the main magnetic pole N1. At this position, the developer D adsorbed on the outer peripheral surface of the sleeve 13 by a magnetic force of the main magnetic pole N1 rises from the outer peripheral surface of the sleeve 13 as a so-called magnetic brush. The magnetic brush is brought into contact with the electrostatic latent image by rubbing the surface of the photosensitive drum 2, and the toner is selectively moved to the surface of the photosensitive drum 2 by an attraction function of static electricity of the electrostatic latent image and static electricity of toner particles. Consequently, the electrostatic latent image on the surface of the photosensitive drum 2 is developed into a toner image. Thereafter, the remaining developer D is returned to the containing chamber 9 and agitated, and is drawn up by the draw-up magnetic pole N3 again.

Figure 2:
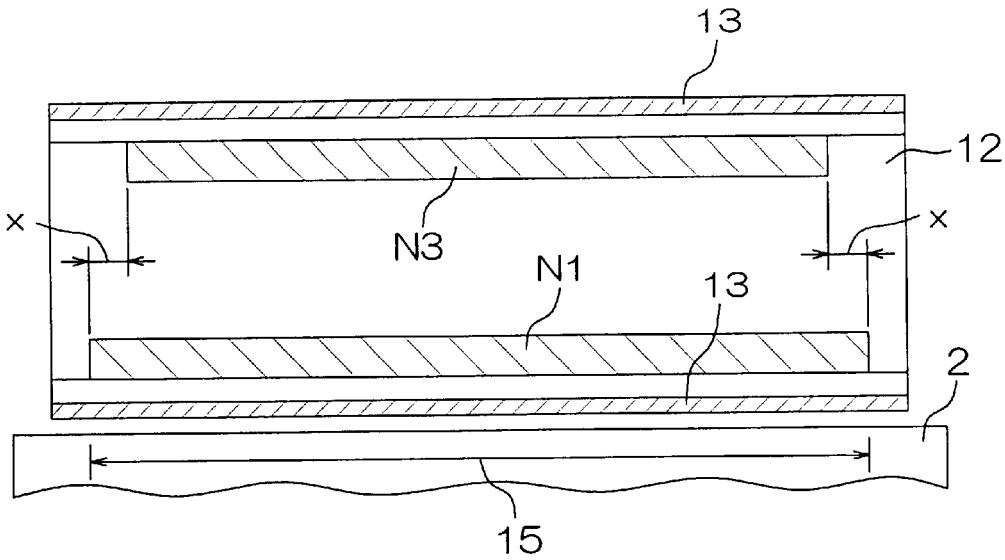
FIG. 2 is a cross-sectional view taken along a line A—A shown in FIG. 1.

FIG. 2 is a cross-sectional view taken along a line A—A shown in FIG. 1. As shown in FIG. 2, the main magnetic pole N1 provided in the fixed shaft 12 is opposite to an effective image region 15 of the photosensitive drum 2 through the sleeve 13.

On the other hand, the draw-up magnetic pole N3 is provided at a position spaced approximately 180° apart from the main magnetic pole N1. The length of the draw-up magnetic pole N3 is made smaller than the length of the main magnetic pole N1 such that both ends in the axial direction of the draw-up magnetic pole N3 are respectively positioned inward by a predetermined size x (x=10 mm±5 mm) from both ends in the axial direction of the main magnetic pole N1. For example, the length of the main magnetic pole N1 is 303.5 mm, and the length of the draw-up magnetic pole N3 is 283.5 mm.

Consequently, the amount of the developer D adhering to the vicinity of an end in the axial direction of the sleeve 13 by the draw-up magnetic pole N3 can be reduced. The draw-up magnetic pole N3 may be at a position other than the position spaced 180° apart from the main magnetic pole N1. In short, the draw-up magnetic pole N3 may be on the upstream side of the control plate 14, as viewed in the direction of rotation of the sleeve 13.

Figure 3:
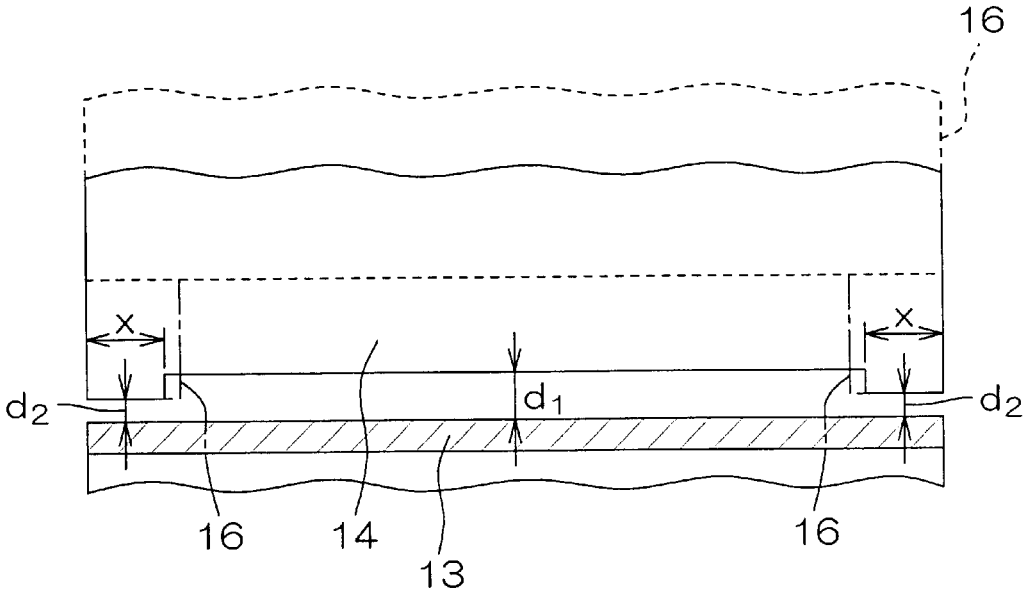
FIG. 3 is a cross-sectional view taken along a line B—B shown in FIG. 1.

FIG. 3 is a cross-sectional view taken along a line B—B shown in FIG. 1.

The control plate 14 has its edge extending in the axial direction of the sleeve 13, and is having a space $d_1$=0.6 mm apart from the outer peripheral surface of the sleeve 13. The present embodiment is characterized in that the control plate 14 is having a space $d_2$=0.4 mm apart from the outer peripheral surface of the sleeve 13 in regions of a predetermined size at both its ends in the axial direction. The width x of the regions where the space is narrow at both the ends is 10 mm±5 mm, for example.

The space between the edge of the control plate 14 and the outer peripheral surface of the sleeve 13 is thus defined, thereby restricting the thickness of the developer adhering to both the ends in the axial direction of the sleeve 13 to a thickness smaller than the thickness of the developer D adhering to the center thereof.

Both ends of the supporting member 16 may be projected beyond the control plate 14 to restrict the thickness of the developer D adhering to both the ends in the axial direction of the sleeve 13 to a smaller thickness instead of projecting both the ends of the edge of the control plate 14.

By such construction, a magnetic brush formed by the developer D adhering to the outer peripheral surface of the sleeve 13 is approximately uniform in the axial direction when it reaches a position opposite to the main magnetic pole NI. Accordingly, only both the ends in the axial direction of the photosensitive drum 2 are not exposed to a magnetic brush having a high developer density, and both the ends in the axial direction of the photosensitive drum 2 are not strongly rubbed by the magnetic brush.

As a result, the photosensitive drum 2 is brought into contact with the magnetic brush almost uniformly in the axial direction, thereby eliminating the problem such as that an image to be formed is degraded at its ends.

As viewed from the developer D, the developer D is not strongly rubbed onto both the ends of the photosensitive drum 2. Accordingly, such a phenomenon that the surface of the carrier is coated with a photoreceptor composition or a toner composition due to friction to prevent triboelectric charging of the toner is alleviated, thereby producing the effect of improving the life of the developer D.

Furthermore, as viewed from the developing roller 8, a peripheral surface at both the ends in the axial direction of the sleeve 13 is not excessively rubbed, thereby producing the effect of improving the life of the developing roller 8.

In the present embodiment, description was made of an example in which the length of the draw-up magnetic pole N3 is made smaller than the length of the main magnetic pole N1, and the space between the control plate 14 and the sleeve 13 is shortened at both ends in the axial direction of the sleeve 13. However, in order to attain the object of the present invention, only such construction that the length of the draw-up magnetic pole N3 is smaller than the length of the main magnetic pole N1 may be employed. Alternatively, only such construction that the length of the main magnetic pole N1 and the length of the draw-up magnetic pole N3 are the same, but the space between the control plate 14 and the sleeve 13 is made shorter at both ends in the axial direction of the sleeve 13 than that at the center thereof may be employed. In this case, a member for defining the space at both the ends in the axial direction may be realized by the supporting member 16 in place of the control plate 14.

The present invention is not limited to the above-mentioned embodiment, various changes may be made in the range of the claims.

Although the present invention has been described and illustrated in detail, it is clearly understood that the same is by way of illustration and example only and is not to be taken by way of limitation, the spirit and scope of the present invention being limited only by the terms of the appended claims.

This application corresponds to a Japanese Patent Application No. 2001-365838 filed in the Japanese Patent Office on Nov. 30, 2001, the disclosure of which is incorporated herein by reference.

What is claimed is:

1. A developing device for developing an electrostatic latent image into a toner image using a two-component developer having toner particles and carrier particles, comprising:

a developing roller having a fixed shaft and a cylindrical sleeve externally fitted on the fixed shaft and rotating in one direction, the fixed shaft having a draw-up magnetic pole, extending in the axial direction, provided for magnetically adsorbing the developer on an outer peripheral surface of the sleeve and a main magnetic pole, extending in the axial direction, provided on the downstream side as viewed in the direction of rotation of the sleeve and at a position facing to the electrostatic latent image, the length of the draw-up magnetic pole being made shorter then the length of the main magnetic pole such that both ends in the axial direction of the draw-up magnetic pole are respectively inward in the axial direction by a predetermined length from both ends in the axial direction of the main magnetic pole, wherein a control plate for restricting the thickness of the developer magnetically adsorbed on the outer peripheral surface of the sleeve to a predetermined thickness is provided opposite to the outer peripheral surface of the sleeve positioned between the draw-up magnetic pole and the main magnetic pole as viewed in the direction of rotation of the sleeve, a space between the control plate and the outer peripheral surface of the sleeve being made narrower in regions at both ends in the axial direction of the control plate than that in the other region.

2. The developing device according to claim 1, wherein said predetermined length of both ends of the draw-up magnetic pole and the width of the regions at the narrower space from the outer peripheral surface of the sleeve are approximately equal to each other.

3. A developing device for developing an electrostatic latent image into a toner image using a two-component developer having toner particles and carrier particles, comprising:

a developing roller having a fixed shaft and a cylindrical sleeve externally fitted on the fixed shaft and rotating in one direction, the fixed shaft having a draw-up magnetic pole, extending in the axial direction, provided for magnetically adsorbing the developer on an outer peripheral surface of the sleeve and a main magnetic pole, extending in the axial direction, provided on the downstream side as viewed in the direction of rotation of the sleeve and at a position facing to the electrostatic latent image, a control plate for restricting the thickness of the developer magnetically adsorbed on the outer peripheral surface of the sleeve to a predetermined thickness being provided opposite to the outer peripheral surface of the sleeve positioned between the draw-up magnetic pole and the main magnetic pole as viewed in the direction of rotation of the sleeve, a space between the control plate and the outer peripheral surface of the sleeve being made narrower in regions at both ends in the axial direction of the control plate than that in the other region, whereby the thickness of the developer magnetically adsorbed on the outer peripheral surface of the sleeve is made approximately equal to the thickness at both the ends of the outer peripheral surface when the outer peripheral surface of the sleeve is over the main magnetic pole.

4. A developing device for developing device for developing an electrostatic latent image into a toner image using a two-component developer having toner particles and carrier particles, comprising:

a developing roller having a fixed shaft and a cylindrical sleeve externally fitted on the fixed shaft and rotating in one direction, the fixed shaft having a draw-up magnetic pole, extending in the axial direction, provided for magnetically adsorbing the developer on an outer peripheral surface of the sleeve and a main magnetic pole, extending in the axial direction, provided on the downstream side as viewed in the direction of rotation of the sleeve and at a position facing to the electrostatic latent image, a control plate for restricting the thickness of the developer magnetically adsorbed on the outer peripheral surface of the sleeve to a predetermined thickness, being provided opposite to the outer peripheral surface of the sleeve positioned between the draw-up magnetic pole and the main magnetic pole as viewed in the direction of rotation of the sleeve, and a supporting member for supporting the control plate, both ends of the supporting member projecting toward the sleeve such that the space between the supporting member and the outer peripheral surface of the sleeve is made narrower in regions, opposite to both ends of the sleeve, of the supporting member than the space between the control plate and the outer peripheral surface of the sleeve.

* * * * *